US008757761B2

(12) United States Patent
Mizutori et al.

(10) Patent No.: US 8,757,761 B2
(45) Date of Patent: Jun. 24, 2014

(54) INK-JET APPLICATION APPARATUS AND METHOD

(75) Inventors: Ryosuke Mizutori, Ibaraki (JP); Junichi Matsui, Ibaraki (JP); Yoshitsugu Miyamoto, Ryugasaki (JP); Katsuyoshi Watanabe, Kudamatsu (JP); Hideo Nakamura, Ushiku (JP)

(73) Assignee: Hitachi, Ltd., Tokyo (JP)

( * ) Notice: Subject to any disclaimer, the term of this patent is extended or adjusted under 35 U.S.C. 154(b) by 380 days.

(21) Appl. No.: 13/008,129

(22) Filed: Jan. 18, 2011

(65) Prior Publication Data

US 2011/0181651 A1 Jul. 28, 2011

(30) Foreign Application Priority Data

Jan. 18, 2010 (JP) ..... 2010-8270

(51) Int. Cl.
*B41J 29/38* (2006.01)
*B41J 29/393* (2006.01)

(52) U.S. Cl.
USPC ..... 347/19; 347/16

(58) Field of Classification Search
USPC ..... 347/19
See application file for complete search history.

(56) References Cited

U.S. PATENT DOCUMENTS 8,181,595 B2 * 5/2012 Kojima ..... 118/302

FOREIGN PATENT DOCUMENTS

JP 2004148180 * 5/2004 ..... B05C 5/00
JP 2009-095690 5/2009

* cited by examiner

*Primary Examiner* — Uyen Chau N Le
*Assistant Examiner* — Kajli Prince
(74) *Attorney, Agent, or Firm* — Antonelli, Terry, Stout & Kraus, LLP.

(57) ABSTRACT

A film paid out from a feed side film roll is conveyed so that an application target area of the film is located on a suction table in an application portion. Image-capturing cameras are disposed so as to be adjacent to ink-jet application heads so that one application head and one image-capturing camera are integrated with each other in terms of position of installation to form one application head unit portion. Each application head unit portion is moved above the suction table by a three-dimensionally movable XYZ-direction driving unit. A position where application will be performed next is image-captured by each of the image-capturing cameras in advance during the applying operation due to each of the application heads. A result of image capturing by each of the image-capturing cameras is processed by an image processing unit.

4 Claims, 11 Drawing Sheets

INK-JET APPLICATION APPARATUS AND METHOD

BACKGROUND OF THE INVENTION

1. Field of the Invention

The present invention relates to an apparatus and method for performing ink-jet application accurately in application of a liquid material on a smooth member by an ink jet technique in such a manner that data obtained by an image-capturing unit are subjected to image processing to calculate a current position of a groove to be subjected to application and calculate a displacement quantity from a reference position for a next application time to correct the position of an application head and move the application head to the corrected position.

2. Description of the Background Art

The ink jet technique is a technique for discharging a small amount of liquid drops accurately from an ink-jet head using air bubbles or piezoelectric elements. An apparatus for applying a liquid material on a target member by the accurate discharge of liquid drops is an ink-jet application apparatus. The ink-jet application apparatus has recently attracted attention as an apparatus capable of achieving high-definition application. The applicability of the ink-jet application apparatus not only to printing on paper but also to all industrial fields has been explored, so that the ink-jet application apparatus has been already put into practical use.

There has been heretofore proposed a technique in which pattern application is performed on a substrate to eliminate the influence due to a difference in injection state between heads and a positional displacement of the application dots is measured by a camera to calculate the quantity of movement and move the head in XYθ directions to thereby perform correction so that the head approaches a target position. In this manner, the technique can reduce position variation in accordance with each application dot so that a uniform, even and high-quality panel can be produced (e.g. see JP-A-2009-95690).

Factors for determining accuracy of application position in ink-jet application are roughly classified into two factors. The first factor is position variation in accordance with each application dot based on a direction of injection of liquid drops from nozzle holes of an ink-jet application head. The second factor is the degree of coincidence of the nozzle holes of the ink-jet application head with the position of application on a target to be subjected to application.

The technique described in JP-A-2009-95690 can give solution for the first factor but cannot give sufficient solution for the second factor in accordance with the kind of the member to be subjected to application.

In the following description, the member to be subjected to application is a flexible laminated film with long groove-like patterns (hereinafter referred to as scribes) formed in a surface of the film. Although such scribes are formed by laser beams or the like, irradiation position error of laser beams occurs because the film is made of a flexible material.

There may be also conceivable a method in which alignment marks provided at regular intervals are image-captured by a camera to be recognized after the member to be subjected to application is positioned to an application place, so that the positioning state of the member to be subjected to application is measured. However, because the film is heated/cooled in a process before the application process, expansion/contraction arises in the laminated film to cause a positional displacement of the alignment marks. There arises a problem that the position of the nozzle holes of the ink-jet application head is displaced from the position where application should be performed.

SUMMARY OF THE INVENTION

In order to solve the aforementioned problem, an object of the invention is to provide an ink-jet application apparatus and method in which a target position of a surface of a flexible laminated film to be subjected to application is corrected and liquid drops are injected from nozzle holes of ink-jet application heads to a correct position so that the quality of application on the film can be improved.

To achieve the foregoing object, the invention provides an ink-jet application apparatus including an upstream side guide roller which pays out and conveys a roll-like film, a suction table which adsorptively holds the paid-out film, an application head which applies a liquid coating material on the film adsorptively held by the suction table, and a downstream side guide roller which conveys the film coated with the coating material and winds up the film like a roll, wherein: an image-capturing camera is disposed so as to be adjacent to the application head and integrated with the application head in terms of position of installation to thereby form an application head unit portion; the application head unit portion is moved above the suction table by a three-dimensionally movable XYZ-direction driving unit; an image of a position where the coating material will be applied next is captured by the image-capturing camera during an applying operation due to the application head; and a result of image-capturing due to the image-capturing camera is processed by an image processing unit to thereby correct a displacement quantity from an initially set application position and move the application head to the position where the coating material will be applied next.

In the apparatus, a plurality of application head unit portions each having the same configuration as defined above are provided; and the XYZ-direction driving unit is formed so that the application head unit portions can operate integrally in a Y-axis direction as a width direction of the film but the application head unit portions can move individually in an X-axis direction as a length direction of the film and in a Z-axis direction as a height direction of the film.

Further, alignment marks are provided in the application position of the film; the alignment marks are image-captured by the image-capturing camera in a state where the paid-out film is adsortively held; and a positional displacement quantity due to adsorptive holding of the film is corrected so that the application head is moved to the position where the coating material will be applied next.

Further, the application position whose image is captured by the image capturing camera in advance is shaped like striped grooves in section.

According to the invention, a target position of a film surface to be subjected to application is directly measured and corrected and liquid drops are injected from nozzle holes of ink-jet application heads to a correct position to thereby improve quality of application on the film.

DETAILED DESCRIPTION OF THE INVENTION

Embodiments of the invention will be described below with reference to the drawings.

In the embodiments described below, a film for a solar cell, which film contains a non-silicon-based semiconductor material (such as a CIGS thin film), is used as an example of a target for application so that an electrode material or an insulating material is applied on this film by an ink-jet application head to form a film such as an electrode, an insulating film, etc. Incidentally, the CIGS thin film is a semiconductor material thin film composed of Cu (copper), In (indium), Ga (gallium) and Se (selenium), that is, "CIGS" is an arrangement of initial letters of these materials.

Figure 1:
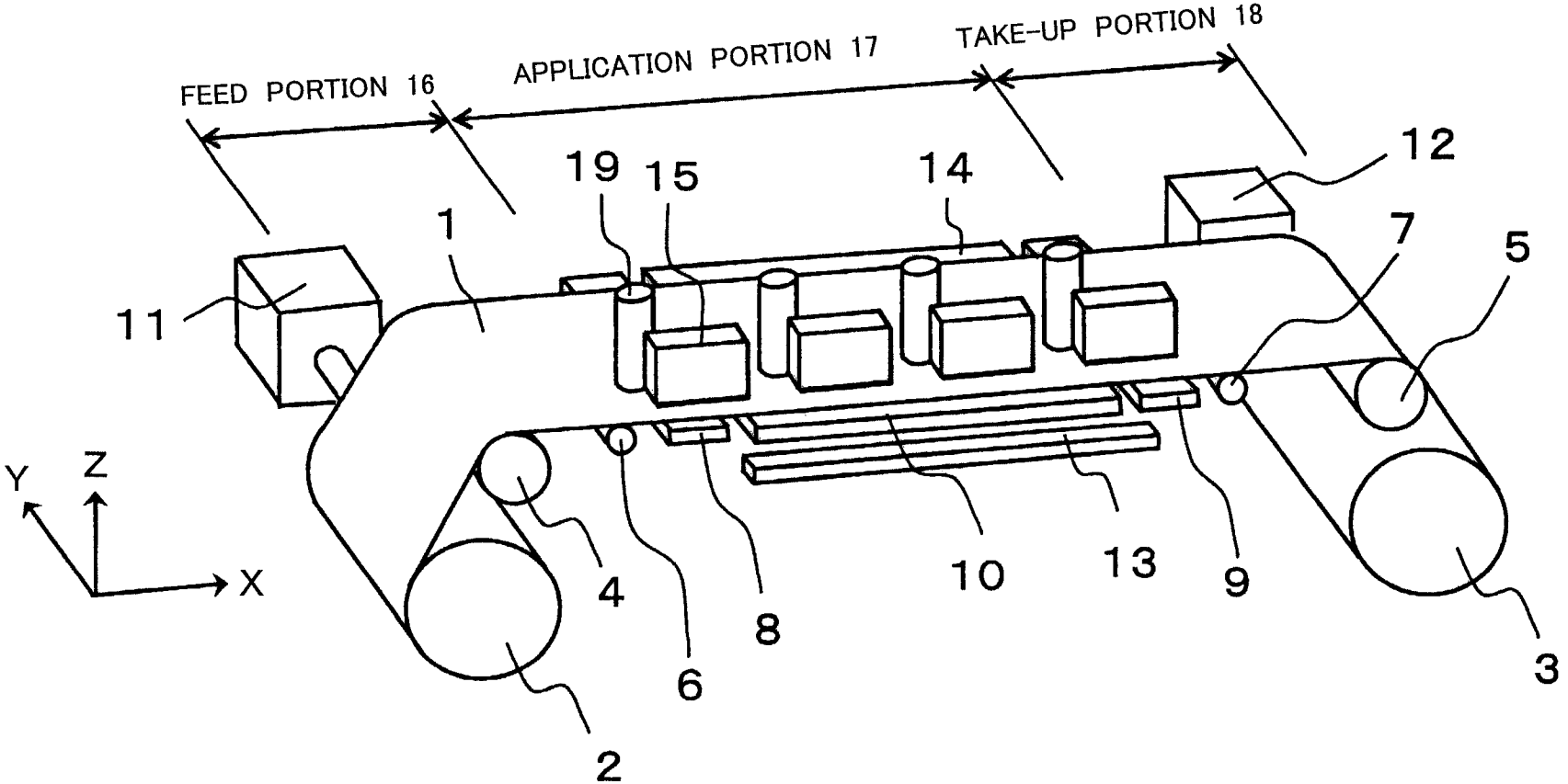
FIG. 1 is a perspective view showing the schematic configuration of an ink-jet application apparatus and method according to a first embodiment of the invention.

FIG. 1 is a perspective view showing the schematic configuration of an ink-jet application apparatus and method as a first embodiment of the invention. In FIG. 1, the reference numeral 1 designates a laminated film (hereinafter simply referred to as film) for a solar cell; 2, a feed side film roll; 3, a take-up side film roll; 4 and 5, guide rollers; 6 and 7, lifting guide rollers; 8 and 9, suction bars; 10, a suction table; 11, a feed side shaft motor; 12, a take-up side shaft motor; 13 and 14, film-pressing bars; 15, application heads; 16, a feed portion; 17, an application portion; 18, a take-up portion; and 19, image-capturing cameras.

Figure 2:
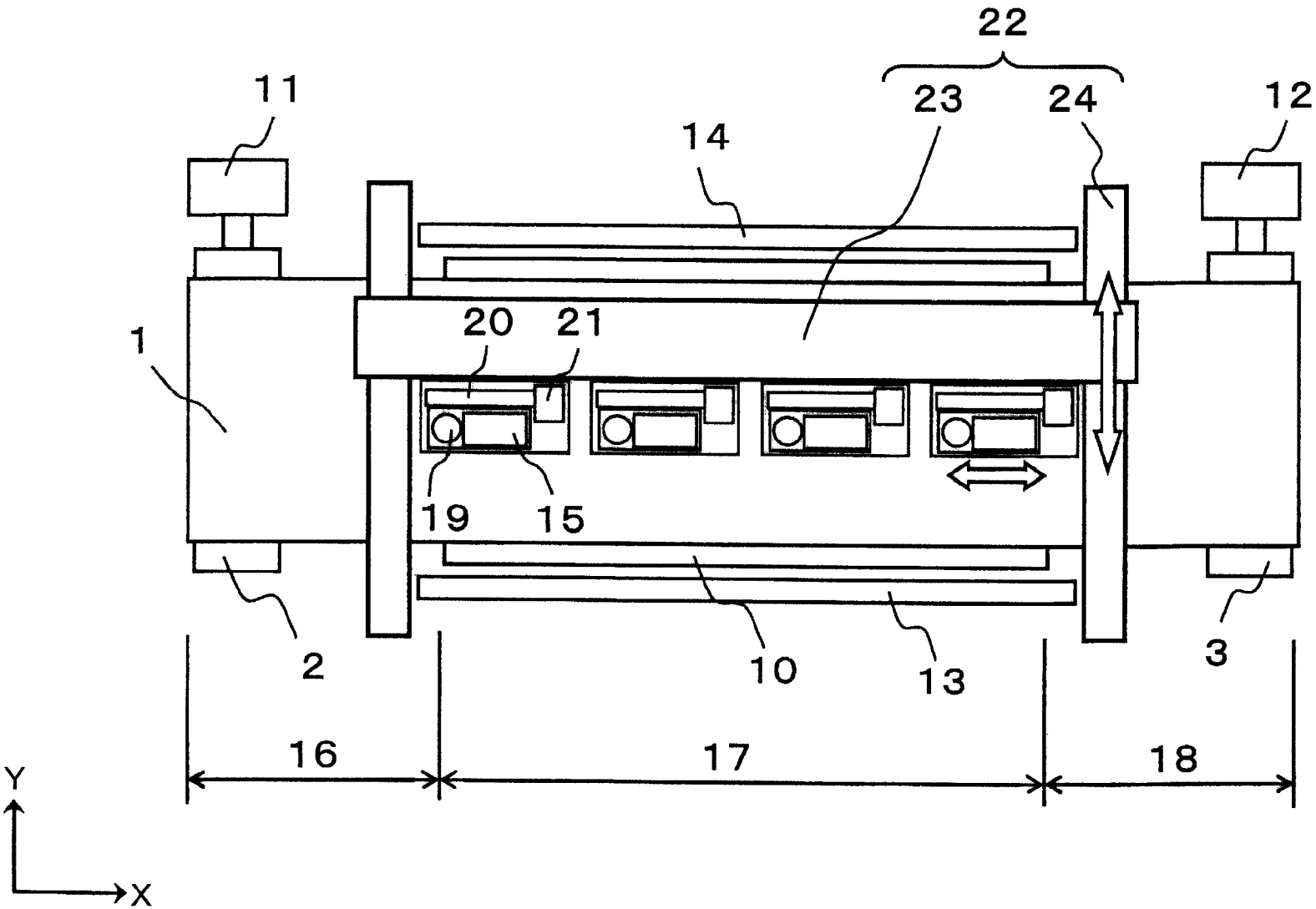
FIG. 2 is a top view showing a state where application heads shown in FIG. 1 are disposed.

FIG. 2 is a plan view specifically showing the configuration of the application portion 17 in FIG. 1. In FIG. 2, the reference numeral 20 designates X-axis driving units; 21, Z-axis driving units; 22, a Y-axis driving unit; 23, a Y-axis gantry; and 24, a Y-axis stage. Parts corresponding to those in FIG. 1 are referred to by the same numerals and characters so that duplicated description thereof will be omitted.

Figure 3:
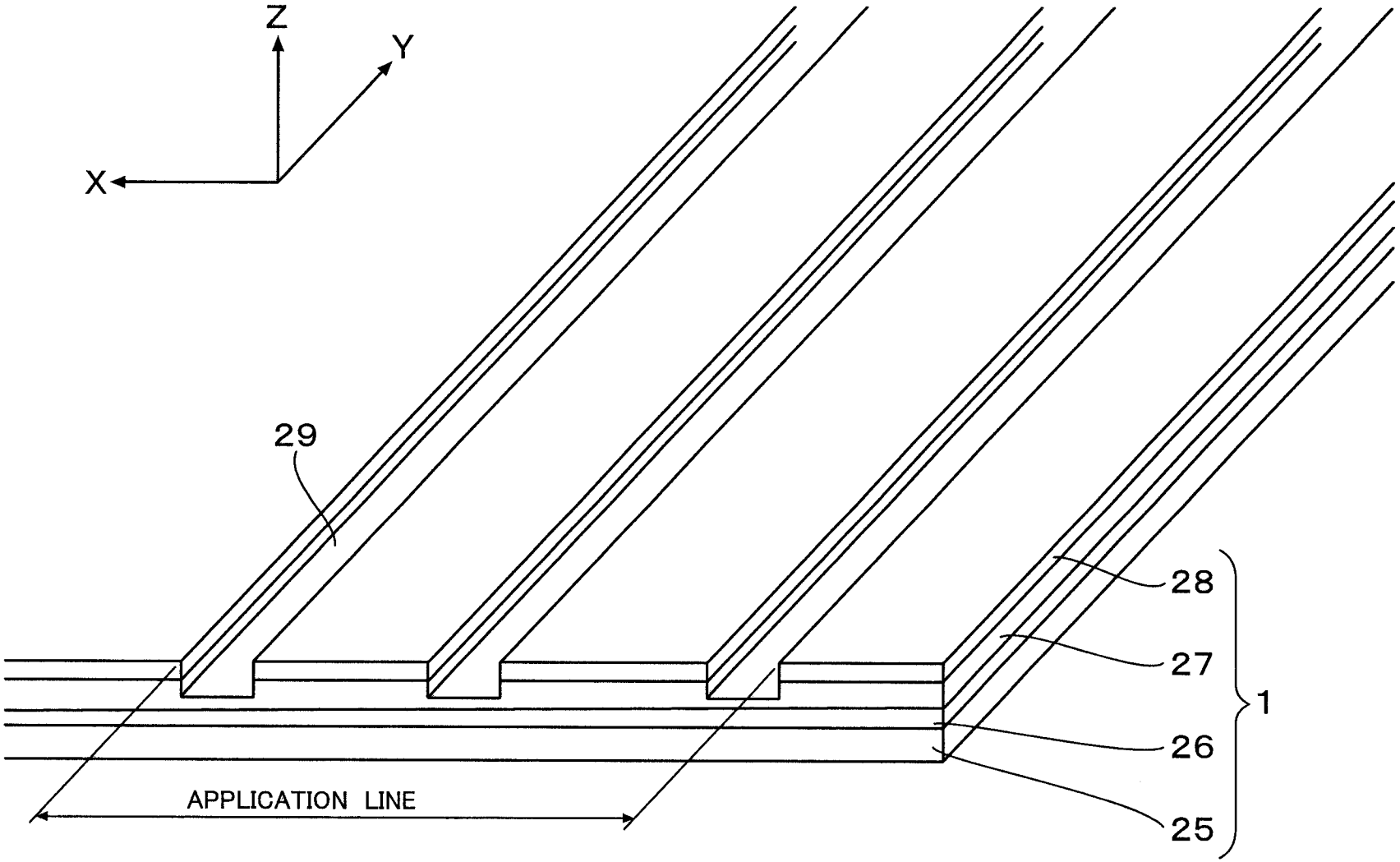
FIG. 3 is an enlarged view showing a film in FIG. 1.

FIG. 3 is a perspective view showing a specific example of configuration of the film 1 in FIG. 1. In FIG. 3, the reference numeral 25 designates a polyimide film layer; 26, a CIGS thin film layer; 27, a buffer layer; 28, a transparent electrode layer; and 29, scribes.

Figure 4:
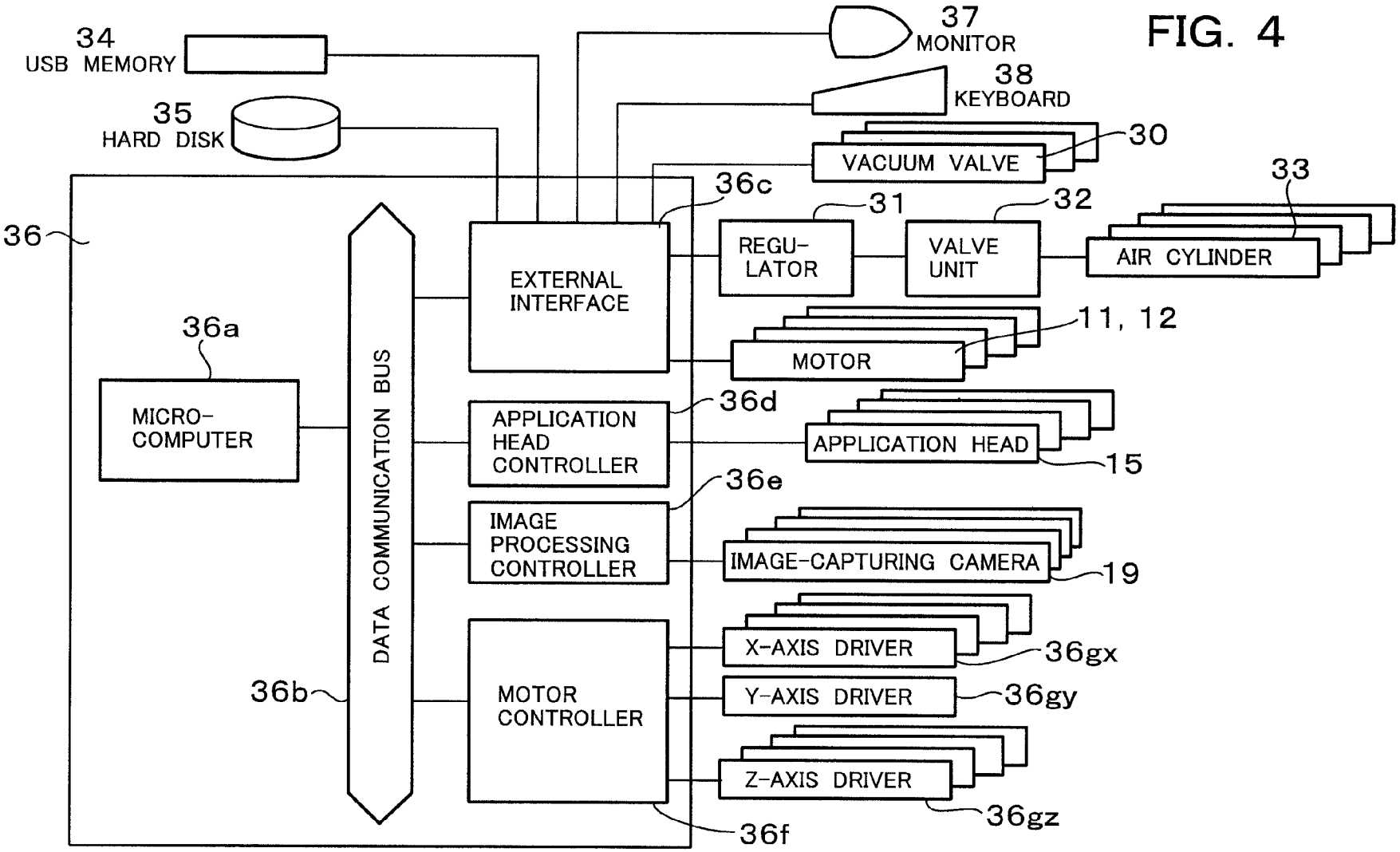
FIG. 4 is a block diagram of a control portion for application position correction in the first embodiment shown in FIG. 1.

In FIG. 1, a space is compartmentalized in an X-axis direction into the feed portion 16, the application portion 17 and the take-up portion 18. The feed side film roll 2 driven to rotate by the feed side shaft motor 11, the upstream side guide roller 4, the lifting guide roller 6 and the suction bar 8 are provided in the feed portion 16 so as to be arranged successively in the X-axis direction. The downstream side suction bar 9, the lifting guide roller 7, the guide roller 5 and the take-up side film roll 3 driven to rotate by the take-up side shaft motor 12 are provided in the take-up portion 18 so as to be arranged successively in the X-axis direction. The suction table 10, the application heads 15 and the film-pressing bars 13 and 14 are provided in the application portion 17. Each of the suction bars 8 and 9 and the suction table 10 uses a vacuum pump as a vacuum source for adsorptively fixing the film 1 or unfixing the film 1 through a vacuum valve 30 (FIG. 4).

In the feed portion 16, the feed side film roll 2 is wound with the film 1 as a target for application of an electrode material or an insulating material in the application portion 17 so that the film 1 is shaped like a roll. The film 1 is paid out from the feed side film roll 2, passes through the application portion 17 and is wound up on the take-up side film roll 3 in the take-up portion 18. Here, the lengthwise direction and the widthwise direction of the film 1 are an X-axis direction and a Y-axis direction respectively, while a direction perpendicular to the plane of the film 1 is a Z-axis direction.

In the application portion 17, the film 1 is vacuum-adsorbed by the suction table 10 so that the position of the film 1 is fixed.

As shown in FIG. 2, the heights of the ink-jet application heads 15 can be changed by the Z-axis driving units 21 individually. The application heads 15 provided with the Z-axis driving units 21 are adjacently fixed to the image-capturing cameras 19 so as to be integrated with the image-capturing cameras 19 to thereby form head unit portions respectively. The combinations of the application heads 15 and the image-capturing cameras 19 can be moved in the X-axis direction by the X-axis driving units 20 respectively so that the positional displacement can be corrected while the position of one combination of an application head 15 and an image-capturing camera 19 relative to another combination (camera unit portion) of an application head 15 and an image-capturing camera 19 is changed.

Although the number of combinations of application heads 15 and image-capturing cameras 19 for forming the camera unit portions may be one, a plurality of combinations of application heads 15 and image-capturing cameras 19 can be used in order to improve processing speed. In this embodiment, four combinations are used. The four combinations are fixed to the common Y-axis gantry 23 so as to be movable along the Y-axis stage 24 in the Y-axis direction parallel to the lengthwise direction of the scribes 29 (FIG. 3) of the film 1 for application. The Y-axis driving unit 22 constituted by the Y-axis gantry 23 and the Y-axis stage 24 may be driven by a servomotor through a ball screw or may be driven by a linear motor.

A liquid electrode material, a liquid insulating material, etc. (hereinafter generically referred to as "coating material") are applied on the film 1 by the ink-jet application heads 15 fixed to the Y-axis gantry 23 as described above, so that an electrode and an insulating film are formed.

Referring back to FIG. 1, when application of the coating material on predetermined application target areas of the film 1 in the application portion 17 is completed, the film 1 is paid out from the feed side film roll 2 while the film 1 is wound up on the take-up side film roll 3 so that application on the continuous film 1 is repeated.

Incidentally, each of the application target areas is an area of the film 1 on which the coating material will be applied by one application head 15 in the application portion 17. As shown in FIG. 2, when a plurality of application heads 15 are used, application target areas are set in accordance with the application heads 15 respectively in the application portion 17.

The film 1 is conveyed from the feed side film roll 2 side to the take-up side film roll 3 side so that next application target areas of the film 1 (application target areas on which the coating material will be applied by the application heads 15 respectively) can be located in positions where the coating material can be applied in the application portion 17. On this occasion, the film 1 paid out from the feed side film roll 2 driven to rotate by the feed side shaft motor 11 is supported by the guide roller 4 and the lifting guide roller 6 in the feed portion 16 but the lifting guide roller 6 on this occasion is lifted up to a higher position than an adsorption surface of the suction table 10, while the film 1 is supported by the lifting guide roller 7 and the guide roller 5 in the take-up portion 18 and wound up on the take-up side film roll 3 but the lifting guide roller 7 on this occasion is lifted up to a higher position than the adsorption surface of the suction table 10. In this manner, the film 1 moves in the X-axis direction without any contact with the suction bars 8 and 9 and the suction table 10.

As described above, when the film 1 is conveyed from the feed portion 16 side to the take-up portion 18 side, the film 1 is lifted up by the lifting guide rollers 6 and 7 so that the film 1 can be conveyed without any contact with the suction table 10 to prevent the rear surface of the film 1 from being scratched.

When the film 1 is conveyed by the lifting guide rollers 6 and 7 without any contact with the suction bars 8 and 9 and the suction table 10 as described above so that next application target areas of the film 1 reach the application portion 17, conveyance of the film 1 is terminated and the application target areas are positioned in the X-axis direction in the application portion 17. Incidentally, the positioning is first performed in such a manner that the position of each application target area is adjusted roughly while the wind-up quantity of the take-up side film roll 3 is monitored.

The take-up side shaft motor 12 is braked to fix the take-up portion 18 side of the film 1. In addition, the feed side shaft motor 11 is torqued in a rotation direction opposite to the rotation direction of paying-out of the film 1 to give predetermined tension to the film 1.

In this manner, even when conveyance of the film 1 is terminated, the film 1 is kept under tension in the lengthwise direction of the film 1 (i.e. in the X-axis direction in which the film 1 is conveyed) so that the film 1 can be prevented from slacking.

In such a state, the lifting guide rollers 6 and 7 are lifted down in the application portion 17 so that the film 1 is adsorptively held on the suction table 10 by the suction bars 8 and 9 adsorptively holding the lower surface of the film 1.

As shown in FIG. 3, the film 1 is formed as a multilayer laminated film which is formed in such a manner that a polyimide film layer 25, a CIGS thin film layer 26, a buffer layer 27 and a transparent electrode layer 28 are laminated successively. The total thickness of the film 1 is in a range of from about tens of μm to about 100 μm. Scribes 29 which are groove-like recess portions are provided on the front surface side of the film 1. A coating material is applied on the scribes 29 to form an electrode or an insulating layer. The film thickness of the CIGS thin film layer 26 is in a range of from about tens of μm to about 100 μm. The CIGS thin film layer 26 serves as a portion which substantially generates electric power.

The scribes 29 are classified into two types, that is, groove-like scribes formed in the transparent electrode layer 28 and the buffer layer 27, and groove-like scribes formed in the transparent electrode layer 28 and the buffer layer 27 and reaching the CIGS thin film layer 26. A material is applied on the groove-like recess portions by an ink jet technique so that the scribes 29 perform intralayer electrical connection or interlayer electric connection. Roughly, the groove width of each scribe 29 is in a range of from about tens of μm to about 100 μm, and the depth of each scribe 29 is in a range of from about several μm to about 10 μm.

Referring back to FIG. 1, each of the application heads 15 can move both in an X-Y plane and in a Z-axis direction (height direction). About 250 nozzle holes facing the film 1 are provided in the lower surface of each application head 15. Liquid drops of the coating material are extruded from the nozzle holes respectively by piezoelectric driving so that the coating material is injected as dots onto the film 1. When the nozzles of the application heads 15 are moved in the X-Y plane by the X-axis driving units 20 and the Y-axis driving unit 22 (FIG. 2) so that coating materials are injected individually, any pattern of coating materials can be applied finely on the application surface of the film 1.

When application of coating materials on predetermined application target areas on the film 1 in the application portion 17 is completed as described above, the film 1 is paid out from the feed side roll film 2 while the film 1 is wound up on the take-up side film roll 3. The coating materials are applied on respective application target areas on the continuous film 1 successively by the application heads 15 in the application portion 17.

FIG. 4 is a block diagram showing an example of configuration of the control portion of the ink-jet application apparatus having the application position correcting function in FIG. 1. In FIG. 4, the reference numeral 30 designates vacuum valves; 31, a regulator; 32, a valve unit; 33, air cylinders; 34, a USB (Universal Serial Bus) memory; 35, a hard disk; 36, a control unit; 36*a*, a micro-computer; 36*b*, a data communication bus; 36*c*, an external interface; 36*d*, an application head controller; 36*e*, an image processing controller; 36*f*, a motor controller; 37, a monitor; 38, a keyboard; 36*gx*, X-axis drivers; 36*gy*, a Y-axis driver; and 36*gz*, Z-axis drivers. Parts corresponding to those in the aforementioned drawings are referred to by the same numerals and characters so that duplicated description thereof will be omitted.

In FIG. 4, the control unit 36 is formed so that the micro-computer 36*a*, the external interface 36*c*, the application head controller 36*d*, the image processing controller 36*e* and the motor controller 36*f* are connected to one another by the data communication bus 36*b*.

The control unit 36 controls driving of air-driven devices such as the air cylinders 33, etc. and roll motors such as the feed side shaft motor 11, the take-up side shaft motor 12, etc. through the external interface 36*c*. The control unit 36 further controls the vacuum valves 30 each of which is switched from the vacuum pump which is a vacuum source when the film 1 is vacuum-adsorbed by the suction bars 8 and 9 (FIG. 1) and the suction table 10 (FIG. 1). The application head controller 36*d* controls presence/absence of injection of coating materials from the respective nozzle holes of the application heads 15 and timing of the injection under control of the control unit 36. The image processing controller 36*e* captures images of the scribes 29 (FIG. 3) and alignment marks 42*a* and 42*b* (which will be described later with reference to FIGS. 10 and 11) by the image-capturing cameras 19 under control of the control unit 36 and calculates positions in the visual field by image processing. The motor controller 36*f* controls driving of the X-axis drivers 36*gx* of the X-axis driving motors, the Y-axis driver 36*gy* of the Y-axis driving motor and the Z-axis drivers 36*gz* of the Z-axis driving motors attached to the application heads 15, under control of the control unit 36.

For application positional displacement quantity correction or film absorptive fixation positional displacement quantity correction, each displacement quantity is calculated by the image processing controller 36*e* and a result of the calculation is converted by the micro-computer 36*a* so as to be reflected on the amount of movement of each motor in the motor controller 36*f*. Then, coating materials are injected from the nozzles of the application heads 15 by the application head controller 36*d* so as to be applied on the film 1.

Figure 5:
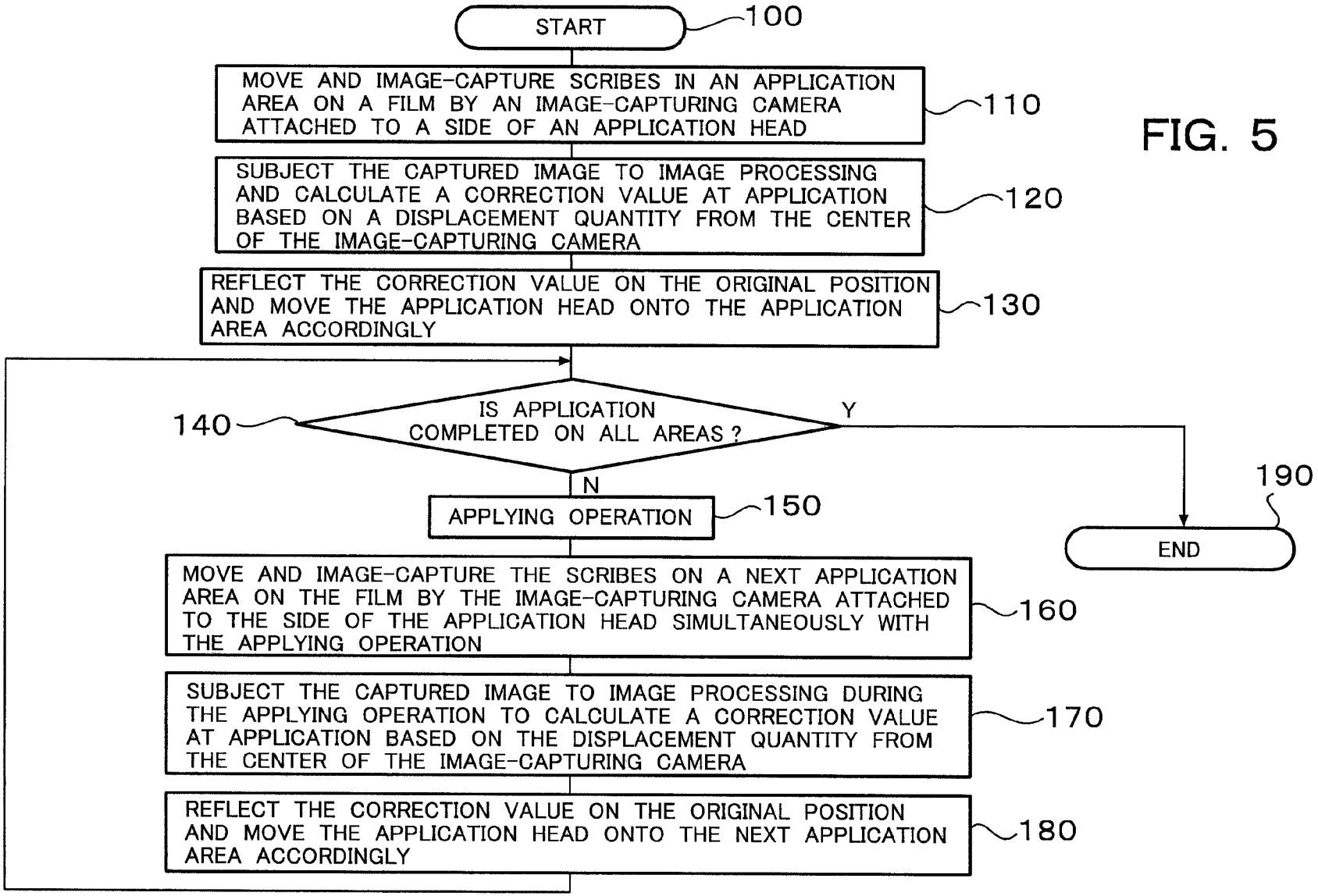
FIG. 5 is a flow chart showing a specific example of application position correction shown in FIG. 1.

FIG. 5 is a flow chart showing a specific example of a series of flows of processes for applying coating materials on application target areas on the film 1 by the application heads 15 shown in FIG. 1. Although one application head will be explained in the following description, the following description applies to other application heads when a plurality of application heads are used.

In FIG. 5, the total flow of processing is as follows. A series of operations in steps 110 to 130 is executed only once initially. A judging process is performed in step 140. A terminating process is performed in step 190, or steps 150 to 180 are repeated in accordance with a result of the judgment.

In the step 110, a moving image of the scribes 29 in the application target area on the film 1 is captured by the image-capturing camera 19 attached to a side of the application head 15. On this occasion, when the coating material cannot be applied on the application target area entirely at once, the application target area is divided into a plurality of areas (hereinafter referred to as partial areas) so that the coating material is applied on the partial areas successively. In the following description, the application target area is assumed so that the coating material is applied in accordance with each partial area. Accordingly, each partial area in the application target area is subjected to image capturing performed by the image-capturing camera 19.

In the step 120, the captured image is subjected to image processing to calculate a correction value at application time based on a displacement quantity from the visual field center of the image-capturing camera 19. In the step 130, the correction value is reflected on the position where the coating material should be applied originally, so that X and Y coordinates of the target position are subjected to addition or subtraction to move the application head 15 onto the application target area accurately.

In the step 140, a judgment is made as to whether application on one whole application target area is completed or not. When application is not completed, the applying operation designated by the steps 150 to 180 which will be described below is repeated in accordance with each partial area. When application of one whole application target area is completed after repetition of the applying operation, the applying process is terminated in the step 190.

When application of the whole application target area (i.e. all partial areas in the application target area) is not completed, an operation of application on one partial area is performed in the step 150. Simultaneously with the applying operation, a moving image of the scribes 29 on a next partial area in the same application target area on the film 1 is captured by the image-capturing camera 19 attached to a side of the application head 15 in the step 160. In the next step 170, the image captured during the applying operation is subjected to image processing so that a correction value for application on a next partial area is calculated based on a displacement quantity from the visual field center of the image-capturing camera 19. Finally, in the step 180, the application head 15 is moved onto the next partial area in consideration of the correction value for the position where the coating material should be applied originally. As described above, the coating material can be applied on partial areas successively in a state where the displacement quantity of the application position is corrected.

Incidentally, each partial area contains a plurality of scribes 29. Generally, each partial area contains several (about five) scribes 29. That is, about 10 scribes 29 are regarded as one group, so that each partial area contains one group of scribes 29. A correction value for a next group (i.e. a next partial area) is measured during the current applying operation in advance.

Figures 6A, 6B, 6C:
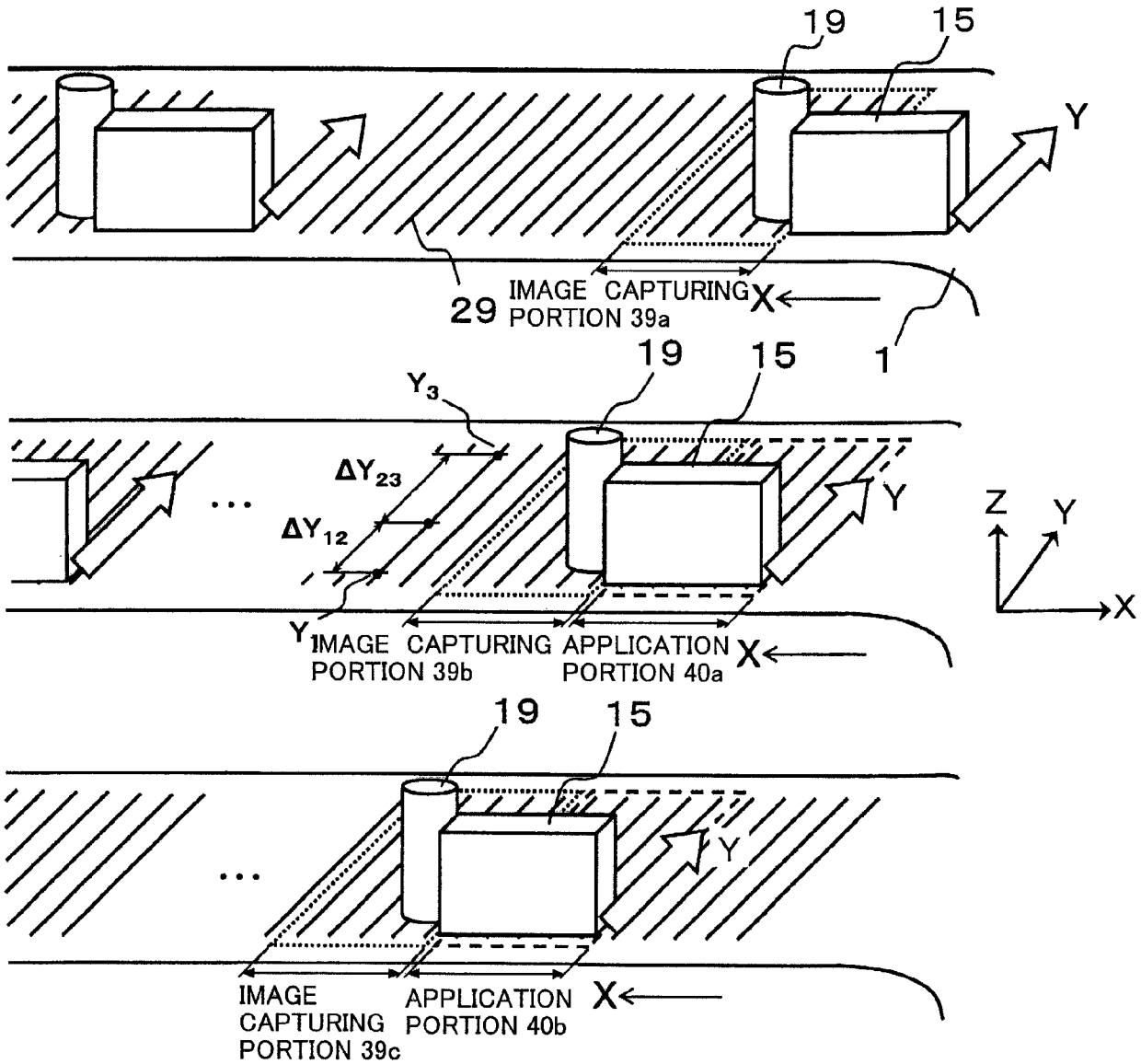
FIGS. 6A to 6C are schematic perspective views showing a specific example of application position correction in the first embodiment shown in FIG. 1.

FIGS. 6A to 6C are perspective views specifically showing the aforementioned processing operation. In FIGS. 6A to 6C, each of the reference numerals 39*a* to 39*c* designates an image-capturing portion, and each of the reference numerals 40*a* and 40*b* designates an application portion. Parts corresponding to those in the aforementioned drawings are referred to by the same numerals and characters so that duplicated description thereof will be omitted.

In FIGS. 6A to 6C, each of the image-capturing portions 39*a* to 39*a* and the application portions 40*a* and 40*b* is an area having a size corresponding to one partial area in the application target area for the application head 15. The image-capturing portions 39*a* to 39*c* are areas subjected to image capturing performed by the image-capturing camera 19. The application portions 40*a* and 40*b* are areas subjected to application performed by the application head 15. Incidentally, five scribes 29 are regarded as one group and each partial area is regarded as containing one group of scribes 29.

FIG. 6A shows the processing operation in the steps 110 to 130 in FIG. 5. A first partial area in the application target area serves as the image-capturing portion 39*a*.

In the image-capturing portion 39*a*, an image of scribes 29 in the first partial area is captured by the image-capturing camera 19 disposed on a side of the application head 15 to obtain the position of the scribes 29. This image capturing is performed while the image-capturing camera 19 is moved together with the application head 15 in the Y-axis direction.

When this image capturing is completed, the application head 15 is moved toward the partial area initially subjected to application (in the X-axis direction) in order to perform application in the first partial area. During the movement of the application head 15, data of the captured image of scribes 29 in the first partial area as an image capturing portion 39*a* captured by the image-capturing camera 19 are subjected to image processing to calculate a correction value for the position of scribes 29 in the partial area on which the coating material will be applied initially (i.e. the partial area serving as the image capturing portion 39*a*) to thereby obtain correction data for correcting the moving position of the application head 15 for application on the partial area as the first application target.

When the application head 15 is moved in the X-axis direction so that the first partial area located in the image capturing portion 39*a* reaches an application start position, the first partial area serves as an application portion 40*a* and the second partial area serves as a next image capturing portion 39*b* as shown in FIG. 6B. When an applying operation (the step 150 in FIG. 5) due to the application head 15 in this state starts, the application head 15 is moved in the Y-axis direction and application is performed. Simultaneously with the application, the X-axis direction position of the application head 15 is adjusted based on the correction data obtained as described above. Consequently, the application head 15 performs application properly along the scribes 29 in the first partial area.

In the image capturing portion 39*b*, an image of scribes 29 in the second partial area as the image capturing portion 39*b* is captured by the image-capturing camera 19 to obtain the position of the scribes 29. When the applying operation on the first partial area in the application portion 40*a* is completed, the application head 15 is moved toward the second partial area (in the X-axis direction). During the movement of the application head 15, the image data previously captured in the image capturing portion 39*b* by the image-capturing camera 19 is subjected to image processing to calculate a correction value for the position of the scribes 29 in the second partial area which will be subjected to application to thereby obtain correction data for correcting the moving position of the application head 15 moving for application on the second partial area. This processing corresponds to the steps 160 to 180 in FIG. 5.

When the application head 15 reaches the second partial area which will be subjected to application next, the second partial area serves as an application portion 40*b* and the third partial area to be subjected to application next serves as an image capturing portion 39*c* as shown in FIG. 6C. In the applying operation on the second partial area, the application head 15 is moved in the Y-axis direction so that application is performed. The X-axis direction position of the application head 15 is adjusted based on the correction data obtained as described above. Consequently, the application head 15 can perform application accurately along the scribes 29 in the second partial area.

Such a series of operations is repeated in accordance with each partial area. When application on all groups in the same application target area is completed, this processing is terminated (step 190 in FIG. 5).

A method of calculating the displacement quantity in the step 120 or 170 in FIG. 5 will be described next with reference to FIGS. 6B and 7 to 9. In this example, X-direction correction is shown because the X-direction displacement quantity becomes particularly remarkable because of the influence of expansion and contraction of the film 1 and positioning of the film.

Figure 8:
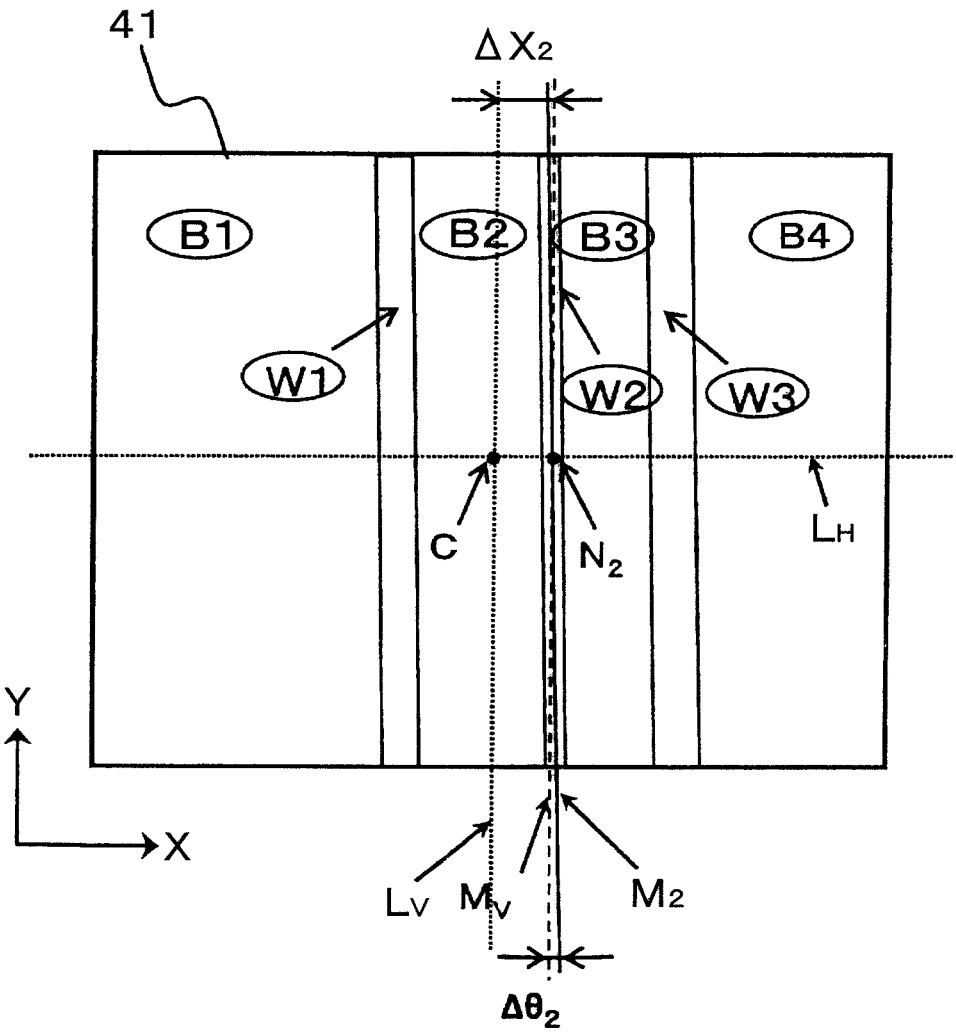
FIG. 8 is a view showing a specific example of a measuring method using a captured image for application position correction shown in FIG. 7.

Description will be made here in the case where an image of scribes 29 is captured in a position $Y_2$ in FIG. 6B. The Y-direction image capturing position on the striped scribes 29 can be set arbitrarily. In the example of FIG. 8, calculation is performed based on a midpoint between the scribes 29. As shown in FIG. 6B, the midpoint is located to be far by $\Delta Y_{12}$ from the application start estimated position $Y_1$.

Figure 7:
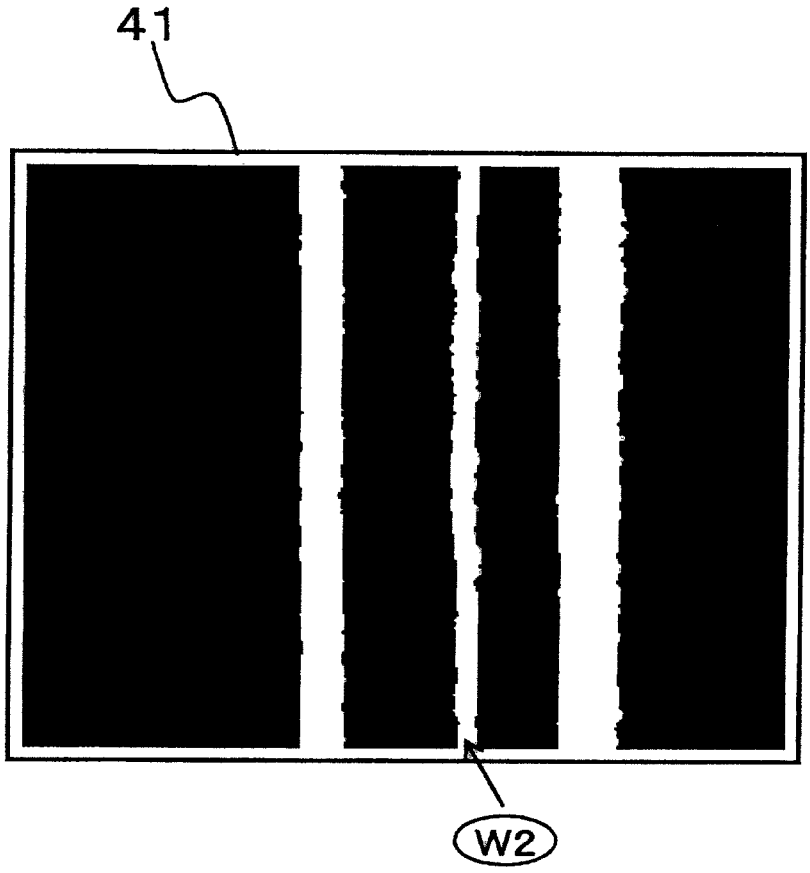
FIG. 7 is a view showing a specific example of a captured image in application position correction shown in FIG. 1.

FIG. 7 is a view showing an image captured by the image-capturing camera 19 in this manner. In FIG. 7, the reference numeral 41 designates a camera visual field.

In the example of FIG. 7, an image of three scribes 29 shaped like grooves in sectional view is captured. For calculation of position of the scribes 29, a window may be set in a central portion in the camera visual field 41 of the image-capturing camera 19 so that the position of a point of brightness change from left and right is extracted to calculate a boundary between a white portion and a black portion. Alternatively, as shown in FIG. 8, a threshold may be set so that the captured image is separated into black objects B1, B2, B3 and B4 and white objects W1, W2 and W3 indicating the scribes 29 by a binarization process.

In FIG. 8, while attention is paid to the white object W2 located in the intermediate position, let point $N_2$ be an intersection point of the white object W2 and a line $L_H$ as the Y-direction center of the camera visual field 41. When an intersection point of the line $L_H$ as the Y-direction center of the camera visual field 41 and a line $L_V$ as the X-direction center of the camera visual field 41 is a point C (that is, the center point of the camera visual field 41), the X-direction distance between the center point C and the point $N_2$ is $\Delta X_2$. The center point C is the position of the white object W2 on design, that is, the position of a scribe 29. The X-direction distance $\Delta X_2$ is an X-direction displacement quantity of the film 1. Moreover, because the scribe 29 is regarded as a line, an intersection point of the scribe 29 and a virtual line parallel to the line $L_H$ is obtained so that the slope angle $\Delta\theta_2$ of the white object W2 to the line $L_V$ can be calculated based on the positional relation between the intersection point on the scribe 29 and the point $N_2$.

Because the displacement quantity $\Delta X_2$ and the slope angle $\Delta\theta_2$ in the position $Y_2$ in the scribe 29 can be calculated, an X-direction displacement quantity in the application start estimated position $Y_1$ can be calculated from FIG. 6B as follows.

$$\Delta X_2+\Delta Y_{12}\cdot\tan(\Delta\theta_2)$$

The X-direction displacement quantity in the position $Y_1$ can be corrected based on this value.

The X-direction displacement quantity in the application end estimated position $Y_3$ in the scribe 29 can be calculated as follows.

$$\Delta X_2+\Delta Y_{23}\cdot\tan(\Delta\theta_2)$$

in which $\Delta Y_{23}$ is the distance from the position $Y_2$ to the application end estimated position $Y_3$. Similarly, the X-direction displacement quantity in the position $Y_3$ can be corrected based on this value. An X-direction displacement quantity at another intermediate point can be calculated in the same manner as described above, so that the positional displacement can be corrected. When the positions $Y_1$ and $Y_3$ do not indicate the application start estimated position and the application end estimated position, positions outside the positions $Y_1$ and $Y_3$ can be corrected in the same manner as described above.

Another method further improved in accuracy in calculation of a displacement quantity compared with the example shown in FIG. 8 will be described with reference to FIG. 9. Incidentally, in FIG. 9, the reference numerals 41*a* and 41*b* designate camera visual fields. Parts corresponding to those in the aforementioned drawings are referred to by the same numerals and characters so that duplicated description thereof will be omitted.

This method calculates a correction value not based on one center point of a scribe 29 but based on two, upper and lower points of a scribe 29. The two points correspond to two points of the positions $Y_1$ and $Y_3$ in FIG. 6B.

Figure 9:
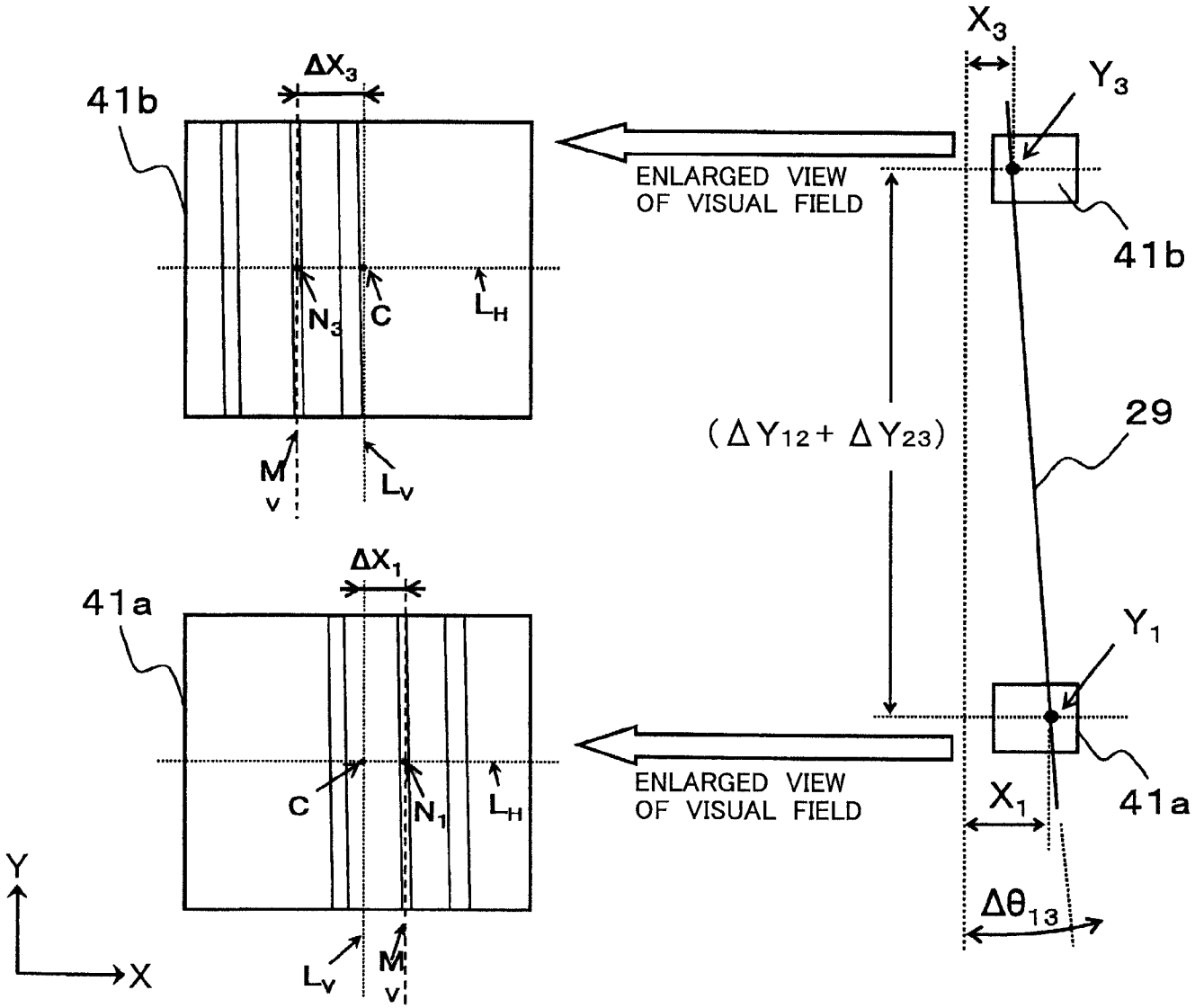
FIG. 9 is a view showing another specific example of the measuring method using a captured image for application position correction shown in FIG. 7.

In FIG. 9, $Y_1$ is one position on the application start estimated position side of the scribe 29, $Y_3$ is one position on the application end estimated position side of the scribe 29, 41*a* is a camera visual field when image capturing is performed by the image-capturing camera 19 before position correction so that the position $Y_1$ coincides with the center point C, and 41*b* is a camera visual field when image capturing is performed by the image-capturing camera 19 before position correction so that the position $Y_3$ coincides with the center point C. Image capturing in the position $Y_3$ is performed after the camera 19 having performed image capturing in the position $Y_1$ is moved in the Y-axis direction to the position $Y_3$. On this occasion, because the X-axis direction displacement quantity is remarkable due to the influence of expansion/contraction and positioning of the film 1, the positions $Y_1$ and $Y_3$ in the camera visual fields 41*a* and 41*b* are displaced in the X-axis direction from the center point of each visual field. Incidentally, the camera visual fields 41*a* and 41*b* are enlarged in the left of FIG. 9.

In the camera visual fields 41*a* and 41*b* in which images have been captured by the image-capturing camera 19, while attention is paid to an intermediate white object W2 (scribe 29) in the images, let points $N_1$ and $N_3$ be intersection points of the line $L_H$ as the respective Y-direction centers of the camera visual fields 41*a* and 41*b* of the image-capturing camera 19 and the positions $Y_1$ and $Y_3$ of the white object W2 and let $\Delta X_1$ and $\Delta X_3$ be the X-direction distances from the center point C of the camera visual fields 41*a* and 41*b* to the points $N_1$ and $N_3$. Because the center point C is the center position of the scribes 29 on design, the distances $\Delta X_1$ and $\Delta X_3$ are X-direction displacement quantities at the respective points of the film 1. Because the value of $(\Delta Y_{12}+\Delta Y_{23})$ indicating the distance between the two points of the positions $Y_1$ and $Y_3$ is determined when image capturing is performed by the image-capturing camera 19, the positions $X_1$ and $X_3$ based on the displacements $\Delta X_1$ and $\Delta X_3$ can be calculated. Accordingly, the slope angle $\Delta\theta_{13}$ of the scribe 29 subjected to application, to the Y-axis direction can be calculated.

Similarly, X-direction displacement quantities in respective positions between the positions $Y_1$ and $Y_3$ can be corrected. Moreover, positions outside the positions $Y_1$ and $Y_3$ can be calculated and corrected on the assumption of virtual lines.

When the slope angle $\Delta\theta_2$ is obtained based on a result of image capturing at one point of the position $Y_2$ as shown in FIG. 8, the Y-direction distance in the visual field of the image-capturing camera 19 is several mm. On the other hand, when image capturing is performed at two points of the positions $Y_1$ and $Y_3$ as shown in FIG. 9, the distance between the two points is so predominantly large that accuracy in calculation of the slope angle $\Delta\theta_{13}$ is improved greatly.

Figure 10:
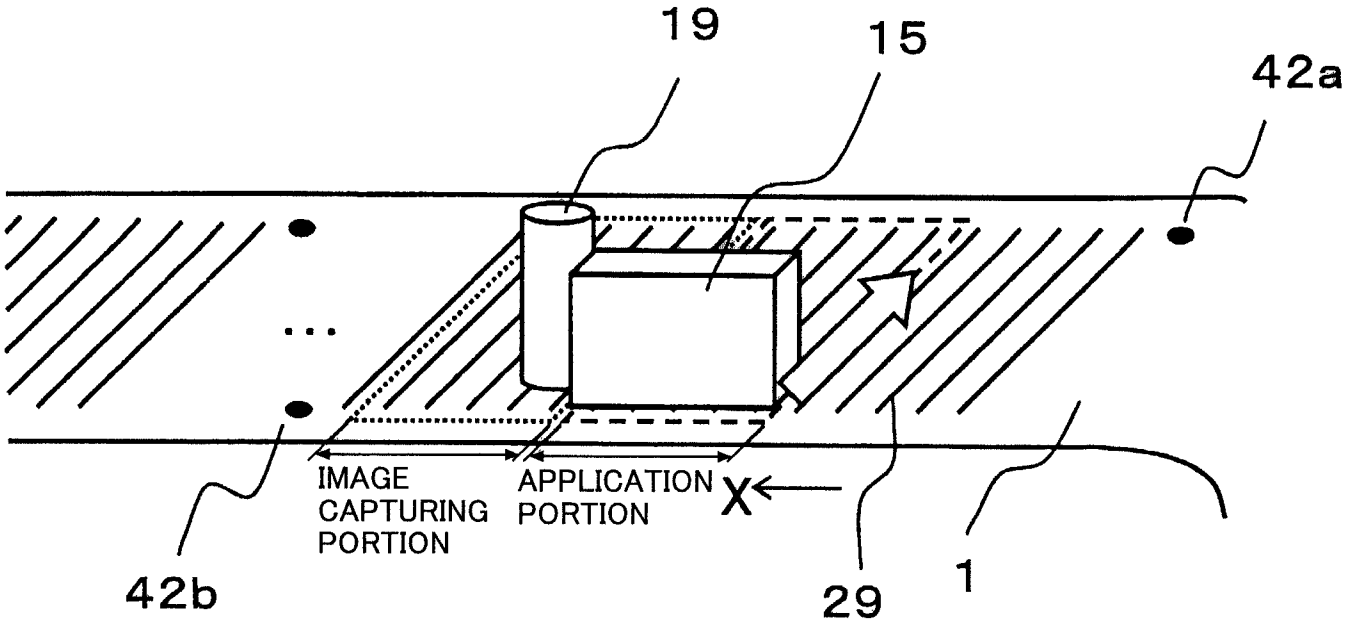
FIG. 10 is a perspective view showing a specific example of application position correction in an ink-jet application apparatus and method according to a second embodiment of the invention.

FIG. 10 is a perspective view showing a state of application in an ink-jet application apparatus and method according to a second embodiment of the invention. In FIG. 10, the reference numerals 42*a* and 42*b* designate alignment marks. Parts corresponding to those in FIG. 1 are referred to by the same numerals and characters so that duplicated description thereof will be omitted.

In FIG. 10, the alignment marks 42*a* and 42*b* are provided on opposite sides respectively in accordance with each application target area of the film 1. The alignment marks 42*a* and 42*b* are image-captured by the image-capturing camera 19 so that the fixation position of the whole of the film 1 fixed to the application portion is grasped by image processing. Because a displacement quantity in a state where the film 1 is paid out can be grasped consequently, the scribes 29 can be image-captured so as to be nearer to the center of the camera visual field when the scribes 29 will be image-captured next time by the image-capturing camera 19. Accordingly, camera resolution can be improved so that more accurate alignment with the application position can be performed.

Figure 11:
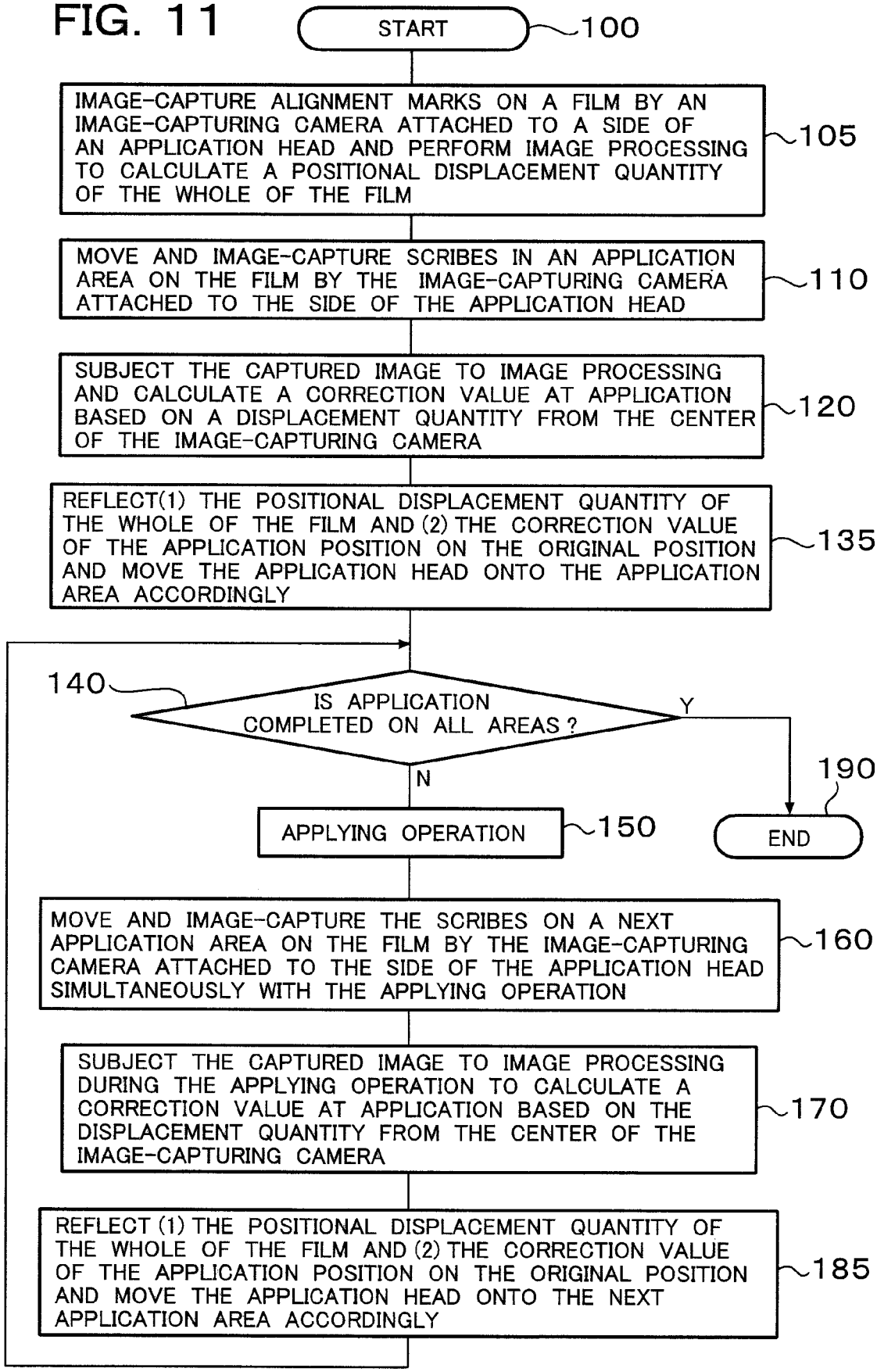
FIG. 11 is a flow chart showing a specific example of a series of flows of the application position correction process shown in FIG. 10.

FIG. 11 is a flow chart showing a processing procedure in this case. Steps corresponding to those in FIG. 5 are referred to by the same numerals and characters so that duplicated description thereof will be omitted.

In FIG. 11, the difference from the processing flow in the first embodiment shown in FIG. 5 is that a process of step 105 for image-capturing the alignment marks 42*a* and 42*b* provided before and after the application target area on the film 1 by the image-capturing camera 19 attached to the application head and performing image processing to calculate an X-axis direction positional displacement quantity of the whole of the film 1 is added as a first step of processing. By the process of the step 105, Y-direction displacement quantities of end portions of the scribes 29 from the positions of the alignment marks 42*a* and 42*b* are calculated for the first purpose of correcting the Y-direction displacement quantity. The fact that the relative positional relation between the position of the alignment marks 42*a* and 42*b* and the position of the scribes 29 is substantially constant in the film 1 is used. A second purpose is to correct the X-direction displacement quantity. The X-axis direction displacement quantity of the application target area in the application portion 17 (FIG. 2) of the film 1 is obtained so that this value is used for correcting the X-axis direction displacement quantity in each partial area in the same application target area.

That is, a process of step 135 is performed in place of the step 130 in FIG. 5. In the step 135, the positional displacement quantity obtained in the step 105 is added to the correction value obtained by the process of the steps 110 and 120 with respect to the first partial area in the same application target area to thereby correct the positional displacement of the application head 15. Specifically, when an applying operation will be performed on the application target area, the application head 15 is first moved to the position of the application target area accurately based on the X-direction correction value of the whole of the film 1 obtained in the step 105. When application is performed on the application target area, the application head 15 is moved along the scribes 29 based on the correction value obtained in FIG. 6B or 8 or the correction value obtained in FIG. 9 in each partial area.

Similarly, the process of step 185 is performed in place of the step 180 shown in FIG. 5 on and after the second partial area in the same application target area. Also in the step 185, the positional displacement quantity obtained in the step 105 is added to the correction value obtained in the process of steps 160 and 170 to thereby correct the positional displacement of the application head 15.

As described above, the position of the scribes 29 is image-captured, the positional displacement of the scribes 29 is image-captured to correct the position of the application head 15 so that the positional displacement of the scribes 29 in a partial area which will be subjected to application next can be corrected. Accordingly, liquid drops can be injected from the nozzle holes of the ink-jet application head to a correct position so that quality of application on the film is improved. In addition, correction is performed in consideration of the positional displacement of the whole of the film so that quality of application on the film is improved more greatly.

What is claimed is:

1. An ink-jet application apparatus comprising:

an upstream side guide roller which pays out and conveys a roll-like film;

a suction table which adsorptively holds the paid-out film;

an application head which applies a liquid coating material on the film adsorptively held by the suction table; and a downstream side guide roller which conveys the film coated with the coating material and winds up the film like a roll, wherein:

an image-capturing camera for capturing an application target area is disposed so as to be adjacent to the application head and integrated with the application head in terms of position of installation to thereby form an application head unit portion;

the application head unit portion is moved above the suction table by a three-dimensionally movable XYZ-direction driving unit; and control means for operating the ink-jet application apparatus such that firstly, the image-capturing camera moves in a direction orthogonal to a conveying direction of the film and captures an image of an application target area on the film only once initially in a series of operations, and before the application head moves to an application start position of the application target area, the image captured by the image-capturing camera is processed to calculate a correction value at application time based on a displacement quantity from a visual field center of the image-capturing camera, and thereafter the correction value is reflected on a position where the coating material should be applied originally and the application head is moved thereto;

next, the image-capturing camera moves in advance and captures an image of a position where the coating material will be applied next at a same time of an applying operation of the application target area due to the application head that is arranged in the position where the coating material should be applied originally; and while the application head moves to an application target area where the coating material will be applied next, a result of image-capturing due to the image-capturing camera is processed by an image processing unit to thereby correct a displacement quantity from an originally set application position and a processing operation of moving the application head to the position where the coating material will be applied next and on which a correction value is reflected is performed and repeated in accordance with each application target area.

2. An ink-jet application apparatus according to claim 1, wherein:

a plurality of application head unit portions each having the same configuration as defined above are provided; and the XYZ-direction driving unit is formed so that the application head unit portions can operate integrally in a Y-axis direction as a width direction of the film but the application head unit portions can move individually in an X-axis direction as a length direction of the film and in a Z-axis direction as a height direction of the film.

3. An ink-jet application apparatus according to claim 1 or 2, wherein:

alignment marks are provided in the application position of the film;

the alignment marks are image-captured by the image-capturing camera in a state where the paid-out film is adsorptively held; and a positional displacement quantity due to adsorptive holding of the film is corrected so that the application head is moved to the position where the coating material will be applied next.

4. An ink-jet application apparatus according to claim 1 or 2, wherein the application position whose image is captured by the image capturing camera in advance is shaped like striped grooves in section.

* * * * *